US007717644B2

(12) United States Patent
Han

(10) Patent No.: US 7,717,644 B2
(45) Date of Patent: May 18, 2010

(54) HYDROPHILIC REVETMENT BLOCK HAVING SEAWATER FLOW PORTS AND CONSTRUCTION METHOD THEREOF

(76) Inventor: Jae Myung Han, 500-1, Jeungsan-ri, Seokseong-myeon, Buyeo-gun, Chungcheongnam-do 323-952 (KR)

( * ) Notice: Subject to any disclaimer, the term of this patent is extended or adjusted under 35 U.S.C. 154(b) by 272 days.

(21) Appl. No.: 11/574,728

(22) PCT Filed: Oct. 12, 2005

(86) PCT No.: PCT/KR2005/003397

§ 371 (c)(1),
(2), (4) Date: Mar. 6, 2007

(87) PCT Pub. No.: WO2006/109912

PCT Pub. Date: Oct. 19, 2006

(65) Prior Publication Data

US 2008/0089743 A1 Apr. 17, 2008

(30) Foreign Application Priority Data

Apr. 13, 2005 (KR) ..... 10-2005-0030567

(51) Int. Cl.
*E02B 3/14* (2006.01)

(52) U.S. Cl. ..... 405/33; 405/16

(58) Field of Classification Search ..... 405/34, 405/35, 21, 30, 31, 33, 15, 16, 17
See application file for complete search history.

(56) References Cited

U.S. PATENT DOCUMENTS 4,666,334 A * 5/1987 Karaus ..... 405/31

(Continued)

FOREIGN PATENT DOCUMENTS

JP 63-151524 10/1988

(Continued)

OTHER PUBLICATIONS

International Search Report for PCT/KR2005/003397, mailed Feb. 8, 2006, 2 pgs.

(Continued)

*Primary Examiner*—Sunil Singh
(74) *Attorney, Agent, or Firm*—Squire, Sanders & Dempsey, L.L.P.

(57) ABSTRACT

The present invention relates to a stairs-type hydrophilic revetment block having seawater flow ports and a construction method thereof. The existing coastal breakwaters, embankment, revetments, etc. are constructed to pacify the sea areas. However, because of occlusiveness of their structure, seawater flow is significantly reduced and pollutants are accumulated without being diffused to the open sea. As a result, the self-cleaning action is interrupted and the benthic ecosystem is in danger of being destroyed due to oxygen deficiency as the accumulated organic materials are decomposed. And, the conventional structures are designed and constructed mainly to block waves in order to pacify the sea areas and protect harbor facilities. In contrast, the stairs-type hydrophilic revetment block having seawater flow ports of the present invention provides easy access for people, reduces reflected waves, pacify the sea areas, maximizes improvement of seawater quality through smooth inflow and outflow of seawater and reduces cost needed for setup and protection of mound. The hydrophilic revetment block of the present invention comprises a base block, an intermediate block and an intermediate block having reservoirs. The present invention also provides a construction method using the revetment block.

5 Claims, 6 Drawing Sheets

U.S. PATENT DOCUMENTS

| | | | | |
|---|---|---|---|---|
| 4,813,812 | A | 3/1989 | Hasegawa et al. | |
| 5,791,827 | A * | 8/1998 | Arvai et al. | 405/286 |
| 6,547,487 | B2 | 4/2003 | Yang | |
| 7,029,200 | B1 * | 4/2006 | Cravens | 405/30 |
| 2008/0075535 | A1 | 3/2008 | Han | |

FOREIGN PATENT DOCUMENTS

| | | | |
|---|---|---|---|
| JP | 2001317029 | A * | 11/2001 |
| KR | 10-282982 | | 12/2000 |
| KR | 1020030002391 | | 1/2003 |
| KR | 20-0330333 | | 10/2003 |
| KR | 2004032694 | A * | 4/2004 |
| KR | 20-0352921 | | 6/2004 |
| KR | 1020040055845 | | 6/2004 |

OTHER PUBLICATIONS

Written Opinion of the International Searching Authority for PCT/KR2005/003397, mailed Feb. 8, 2006, 4 pgs.

* cited by examiner

[Fig. 3]
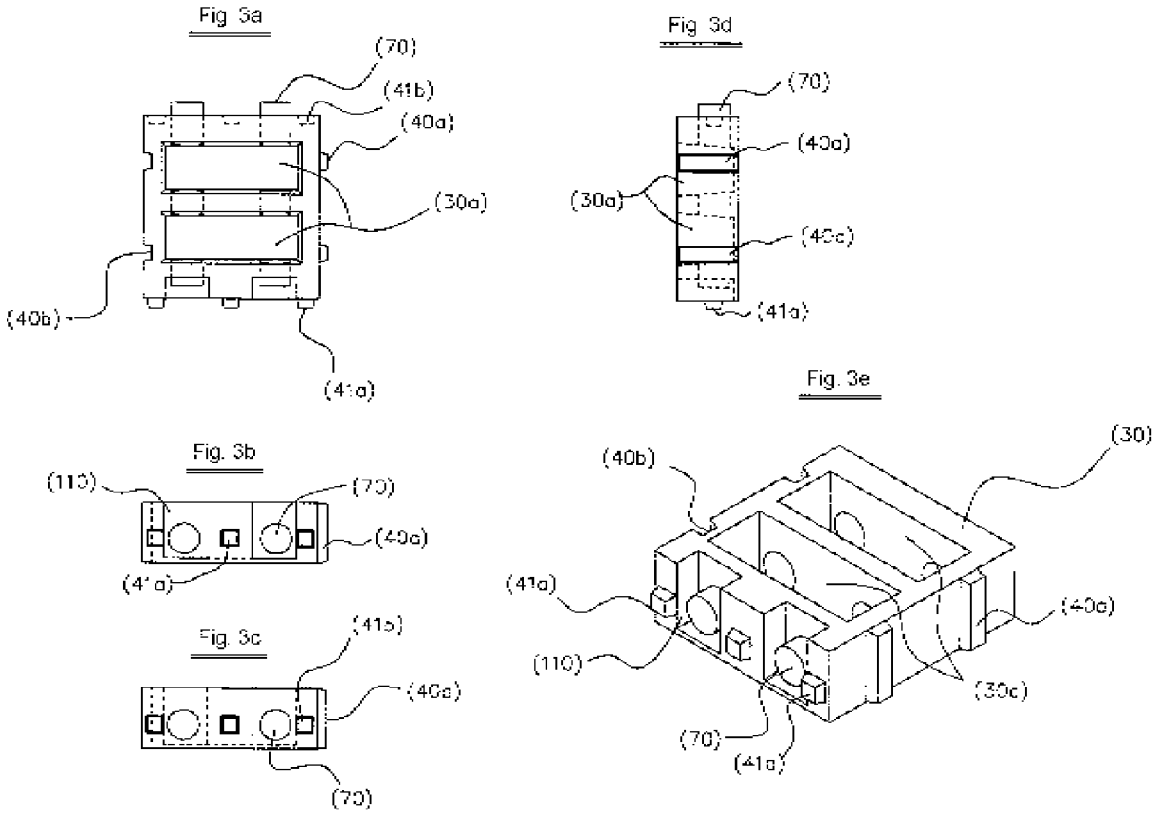
[Fig. 4]
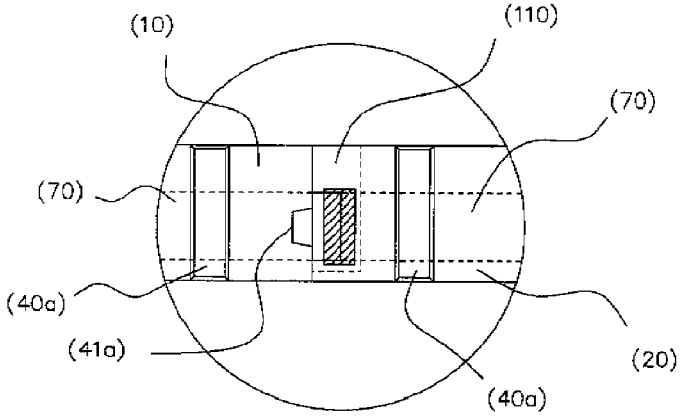

[Fig. 5]
Fig. 5a
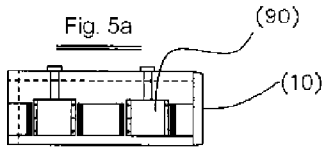
Fig. 5b
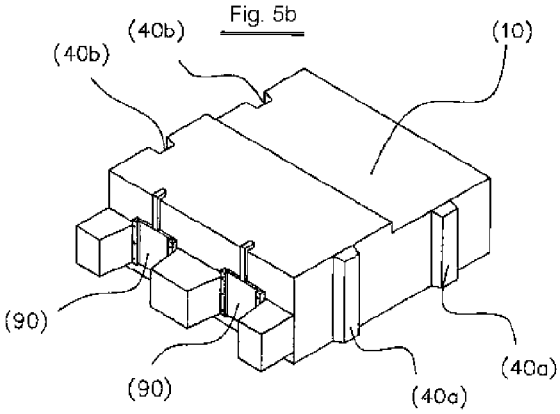
[Fig. 6]
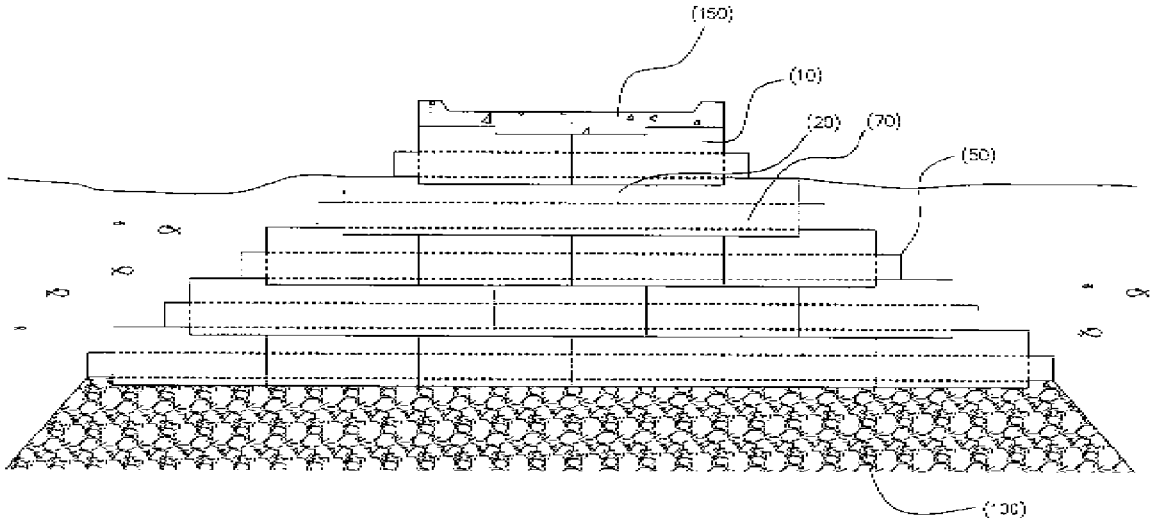

[Fig. 7]
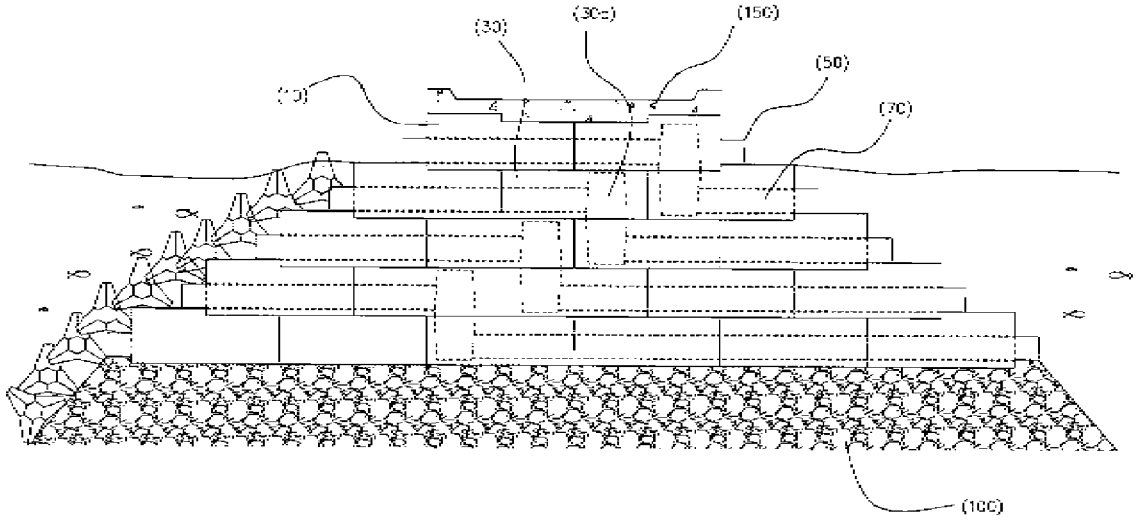
[Fig. 8]
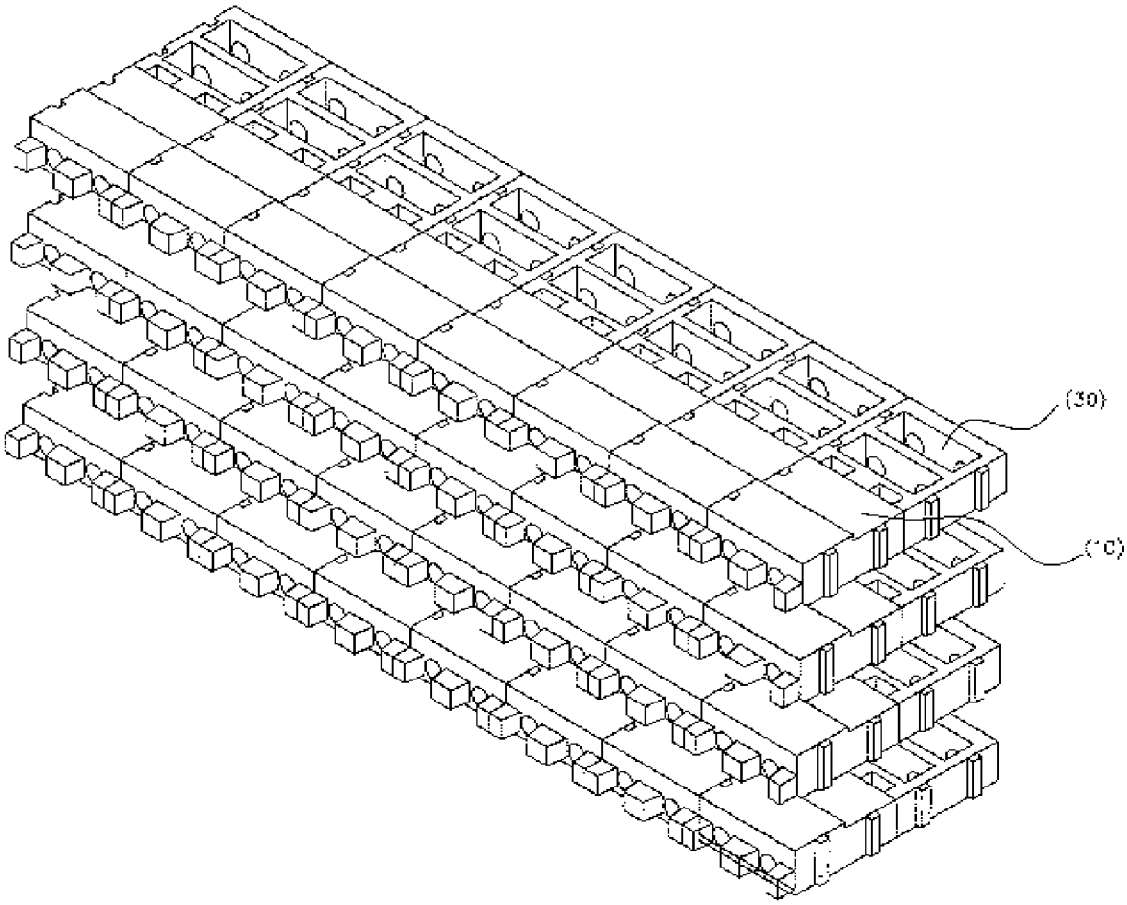

[Fig. 9]
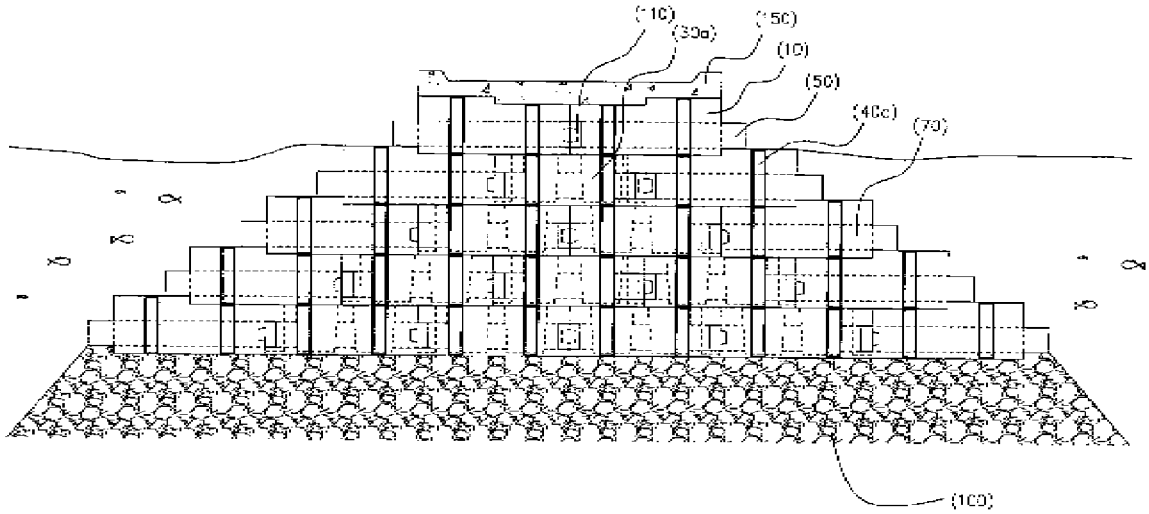
[Fig. 10]
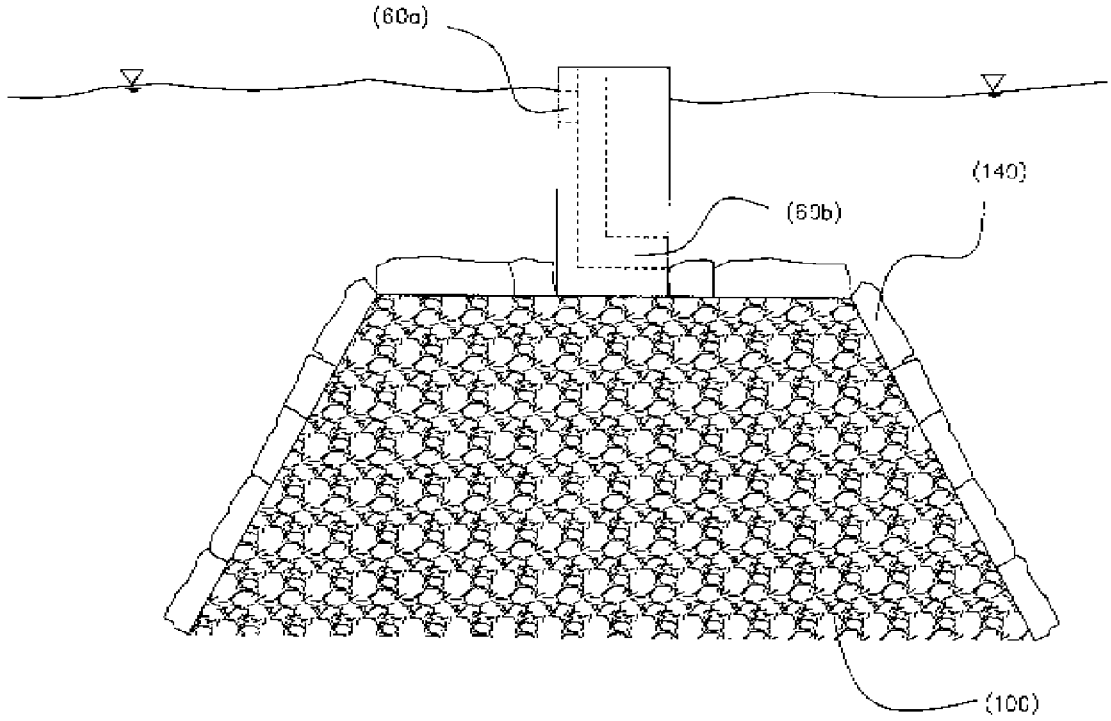

HYDROPHILIC REVETMENT BLOCK HAVING SEAWATER FLOW PORTS AND CONSTRUCTION METHOD THEREOF

TECHNICAL FIELD

The present invention relates to a stairs-type hydrophilic revetment block, more particularly to a stairs-type hydrophilic revetment block having seawater flow ports constructed on the seashore, which improves seawater quality by enabling smooth flow of seawater from the open sea to the inland sea and vice versa and prevents seashore erosion and sedimentation caused by interrupted seawater flow.

BACKGROUND ART

The conventional seawater flow-related structures are mostly upright structures, partly modified from a caisson, which do not allow easy access of people. Since the conventional revetment structures are constructed by setting up a sloping mound as foundation, a large volume of rubble is required. Besides, the seawater flow structure does not adequately cope with the change of seawater level. Seawater from the open sea needs to be flown in at all levels, from the bottom to the top, so that the seawater can be fully circulated. However, in most of the conventional revetment structures, the seawater flows in only at a fixed depth, which restricts circulation of the seawater in the inland sea and makes water quality improvement difficult.

Because the conventional structures are mainly based on the concept that seawater flows from the open sea to the inland sea, they interrupt the flow of seawater and result in seashore erosion and loss of coastal land. In contrast, the structure of the present invention enables smooth flow of seawater.

Korean Patent Publication No. 10-2004-0055845 discloses a structure constructed by setting up frames at regular intervals as posts and laying a hollow slab for finishing. Although it is outstanding in terms of seawater flow, it is problematic in view of hydrophilicity. Korean Utility Model Publication No. 20-033033 discloses a structure in which wave breaking capability is offered at the front of a wave dissipating block. Although it allows flow of seawater to some extent, it does not give easy access to people. The upright revetment breakwater disclosed in Korean Utility Model No. 20-0352921 has improved wave braking and wave dissipating capabilities through modification of the existing caisson-type breakwater. However, it does not give easy access to people, either and because it is complicated in structure, it is restricted in application. Korean Patent Publication No. 10-0431572 discloses a sloping seawater inflow breakwater. This patent can be said to be the most advanced of existing technologies, but it also lacks the ability to cope with the change in seawater level, because the inflow port and the outflow port are fixed. It is mostly for the seawater flow from the open sea to the inland sea and is restricted in wide application.

There are other revetment structures offering seawater flow capabilities, but they are mostly complicated in structure and limited in coping with the change of seawater level.

DISCLOSURE OF INVENTION

Technical Problem

Accordingly, it is an object of the present invention to provide a hydrophilic revetment block which enables smooth flow of seawater regardless of the change of seawater level as the seawater flows in at various depths, minimizes erosion of seashore through smooth flow of the seawater from the open sea to the inland sea and vice versa and offers easy access to people depending on the change of seawater level.

Whereas the conventional techniques a large volume of rubble for setting up of mound and its protection, the present invention does not require additional rubble, except for the minimal foundation work, and thus is economical and offers a convenient construction method.

Technical Solution

The present invention provides a hydrophilic revetment block enabling smooth flow of seawater from the open sea to the inland sea and vice versa. Provided are a base block, an intermediate connection block and an intermediate connection block having reservoirs.

On top of the base block, a step is formed to prevent slip of the base block. In the front of the block, projections are formed to break waves and, depending on the seawater level, serve as stairs that offer access to people. Inside the block, one or more seawater flow ports with circular or polygonal cross-section are formed from the front through the rear of the block. On the left, right and rear sides of the block, projections and indentations are formed to enhance engagement with other blocks. By adjusting the spacing (spacing between the steps when viewed from the side of the block) of the step for preventing slip of the base block, the block can be constructed with any slope to give a stairs-type structure. In addition, a gate may be equipped at the outflow port or inflow port of the base block to control the seawater level.

The intermediate block is positioned at the rear side of the base block. It is designed such that its length can be adjusted depending on the situation of the construction site. Inside the block, one or more seawater flow ports with circular or polygonal cross-section are formed at regular intervals. Also, an intermediate connection block having one or more reservoirs to control seawater flow across a specific cross-section of the intermediate block is provided. Outside the intermediate block, projections and indentations are formed to enhance engagement for structural integrity. Depending on the situation of the construction site, the reservoir may be designed as indentation formed at the top or the bottom of the block or as vertical path formed from the top to the bottom of the block. Position and number of the reservoir(s) may be selected adequately.

Whereas the conventional structures are designed such that seawater flow is possible only at a fixed depth, the present invention enables seawater flow at various depths and thus can effectively cope with the change in seawater level. Also, more diverse capabilities can be attained through different assembly methods. And, whereas the conventional structures need a large volume of rubble for setup and protection of the mound, the revetment block of the present invention can be constructed with a lower cost because it is directly constructed on the foundation and needs not additional protection. In addition, the block can be constructed and carried more conveniently by attaching suspension rings.

More specifically, in claim 1 of the present invention, a base block of a hydrophilic revetment block comprising: a step for preventing slip (80) formed on the upper part of the base block (10); a plurality of projections (50) formed at the front of the base block (10); one or more seawater flow ports (120) having the shape of circular or polygonal cross-section formed from the front through the rear of the base block (10); and at least one engagement projections (40*a*) formed at one side of the base block (10), at least one engagement indentations (40*b*) formed at the opposing side of the base block (10)

and at least one engagement indentations (41*b*) formed at the rear of the base block (10) for enhancing engagement with other blocks, wherein seawater flow pipes (70) are formed in the seawater flow ports (120), said seawater flow pipes being longer than the base block (10) for easy connection with other pipes.

In claim 2 of the present invention, an intermediate connection block having seawater flow ports installed at the rear of the base block (10) of claim 1 is provided, which comprises: at least one seawater flow ports (120) having the shape of circular or polygonal cross-section formed from the front through the rear of the intermediate connection block (20); at least one space for connecting seawater flow pipes (110) formed at one or both ends of the intermediate connection block (20) to enhance engagement of the seawater flow pipes (70); and at least one engagement projections (40*a*) formed at one side of the intermediate connection block (20), at least one engagement indentations (40*b*) formed at the opposing side of the intermediate connection block (20), at least one engagement projections (41*a*) formed at the front of the intermediate connection block (20) and at least one engagement indentations (41*b*) formed at the rear of the intermediate connection block (20) for enhancing engagement with other blocks, wherein seawater flow pipes (70) are formed in the seawater flow ports (120), said seawater flow pipes being longer than the intermediate connection block (20) for easy connection with other pipes.

In claim 3 of the present invention, an intermediate connection block (30) is provided which further comprises at least one reservoirs (30*a*) that control the flow of seawater formed as path penetrating the block from up to down or as indentation at the top or bottom of the block, in addition to the intermediate connection block of claim 2. In other words, the intermediate connection block (30) of claim 3 is obtained by adding the reservoirs (30*a*) to the intermediate connection block (20) of claim 2. The reservoir (30*a*) may be formed as an indentation formed at the top or bottom of the block or as a path penetrating the block from up to down. Preferably, position, number and shape of the reservoirs (30*a*) are selected in consideration of the situation of the construction site.

In claim 4 of the present invention, a base block is provided in which gates (90) are equipped at the inflow ports (60*a*) or outflow ports (60*b*) of the base block of the claim 1 for control of seawater circulation.

In claim 5 of the present invention, a construction method using the hydrophilic revetment blocks of claims 1 to 4 that allows horizontal flow of seawater is provided, which comprises the steps of: setting up a foundation mound (100) using rubble; aligning a base block (10) and an intermediate connection block (20) horizontally on the foundation mound (100) so that each seawater flow port (120) of the base block (10) is connected with each seawater flow port (120) of the intermediate connection block (20); repeating the above step of aligning the base block (10) and the intermediate connection block (20) horizontally to form stairs; filling the remaining space of the space for connecting seawater flow pipes (110) with mortar or rubble; and applying concrete on the base block (10) and the intermediate connection block (20) positioned at the top of the stairs to form a concrete roof structure (150), wherein the step of aligning the base block (10) and the intermediate connection block (20) is performed by positioning the base block (10) at each end of the construction site and the step of forming stairs is performed by stacking the base blocks so that the step for preventing slip (80) of the lower base block (10) engages with the upper base block (10).

In this construction method, the seawater flow ports (120) of the base block (10) and the intermediate connection block (20) are formed horizontally so that the seawater can be flown horizontally. This construction method enables smooth flow of seawater and thus prevents seashore erosion.

In claim 6 of the present invention, a construction method using the hydrophilic revetment blocks of claims 1 to 4 that prevents counterflow of seawater from the inland sea to the open sea at a predetermined depth is provided, which comprises the steps of: setting up a foundation mound (100) using rubble; aligning a base block (10), an intermediate connection block (20) and an intermediate connection block (30) having reservoirs (30*a*) horizontally on the foundation mound (100) so that each seawater flow port (120) of the base block (10), the intermediate connection block (20) and the intermediate connection block (30) having reservoirs (30*a*) is connected in such a manner that the intermediate connection block (30) having reservoirs (30*a*) which is the third block from the open sea side is positioned so that its reservoirs (30*a*) face the opposite direction of the foundation mound (100) and base blocks (10) are positioned at both ends of the construction site; repeating the above step of aligning the base block (10), the intermediate connection block (20) and the intermediate connection block (30) having reservoirs (30*a*) horizontally to form stairs in such a manner that the intermediate connection block (30) having reservoirs (30*a*) which is the second block from the open sea side is positioned so that its reservoirs (30*a*) are communicated with the reservoirs (30*a*) of the intermediate connection block (30) below to form level difference between the inflow port (60*a*) of the open sea side and the outflow port (60*b*) of the inland sea side, so that control of horizontal flow of seawater is possible; filling the remaining space of the space for connecting seawater flow pipes (110) with mortar or rubble; and applying concrete on the blocks positioned at the top of the stairs to form a concrete roof structure (150); wherein the step of forming stairs is performed by stacking the base blocks so that the step for preventing slip (80) of the lower base block (10) engages with the upper base block (10).

In this construction method, flow of seawater is controlled mainly by the base block (10) and the intermediate connection block having reservoirs (30*a*) which is formed at the rear of the base block. As the inflow port (60*a*) of the open sea side and the outflow port (60*b*) of the inland sea side are formed at different levels, counterflow of seawater from the inland sea to the open sea at a predetermined depth can be prevented.

In claim 7 of the present invention, a construction method is provided, in which stairs are formed at various inclination angles by adjusting the spacing of the steps for preventing slip (80) in claims 5 and 6.

ADVANTAGEOUS EFFECTS

The hydrophilic revetment block of the present invention is an inclined structure formed by assembling a base block (10) having seawater flow ports (120), an intermediate connection block (20) and an intermediate connection block (30) having reservoirs (30*a*). While the conventional caisson-type upright structures are restricted in circulation of seawater because the seawater can be flown in and out only at a specific depth, the hydrophilic revetment block of the present invention enables circulation of seawater at various depths, thereby being outstandingly effective in improving seawater quality. And, since it is a stairs-type, not upright, hydrophilic structure, it offers easy access for people.

Whereas the convention structures mainly offer flow of seawater from the open sea to the inland sea, the hydrophilic revetment block of the present invention allows flow of seawater from the open sea to the inland sea, from the inland sea to the inland sea and from the inland sea to the open sea, depending on how it is constructed.

Especially, the hydrophilic revetment block of the present invention can minimize seashore erosion because it enables free circulation of seawater.

Whereas the conventional structures need a large volume of rubble for setup and protection of the mound (100), the revetment block of the present invention can be constructed with a lower cost because it is directly constructed on the foundation and needs not additional protection.

In addition, since flow of seawater can be controlled using the reservoirs (30*a*) of the intermediate connection block, depending on the situation of the site, the present invention is advantageous in view of environmental protection by improvement in seawater quality and prevention of seashore erosion by smooth seawater flow.

BRIEF DESCRIPTION OF THE DRAWINGS

FIG. 1(*a*) is a top view, FIG. 1(*b*) is a front view, FIG. 1(*c*) is a rear view, FIG. 1(*d*) is a right side view and FIG. 1(*e*) is a perspective view.

FIG. 2(*a*) is a top view, FIG. 2(*b*) is a front view, FIG. 2(*c*) is a rear view, FIG. 2(*d*) is a right side view and FIG. 2(*e*) is a perspective view.

FIG. 3 illustrates an intermediate connection block having reservoirs for controlling seawater flow. FIG. 3(*a*) is a top view, FIG. 3(*b*) is a front view, FIG. 3(*c*) is a rear view, FIG. 3(*d*) is a right side view and FIG. 3(*e*) is a perspective view.

FIG. 4 illustrates connection of the seawater flow pipes of the base block and the intermediate connection block in detail.

FIG. 5 illustrates a base block in accordance with the second embodiment of the present invention, which further comprises gates at the front of the base block of FIG. 1 for control of seawater. FIG. 5(*a*) is a front view and FIG. 5(*b*) is a perspective view.

FIG. 6 is a cross-sectional view illustrating the construction that allows horizontal flow of seawater by aligning base blocks and intermediate connection blocks.

FIG. 7 is a cross-sectional view illustrating the construction that controls horizontal flow of seawater and prevents counterflow of seawater at a predetermined depth by aligning base blocks, intermediate connection blocks and intermediate connection blocks having reservoirs.

FIG. 8 is a perspective view illustrating a construction example in accordance with the present invention.

FIG. 9 illustrates a construction example in accordance with the present invention.

FIG. 10 illustrates the conventional construction example.

BEST MODE FOR CARRYING OUT THE INVENTION

Now, the present invention is described in further detail referring to the attached drawings. The hydrophilic revetment block having seawater flow ports of the present invention comprises a base block (10), an intermediate connection block (20) and an intermediate connection block having reservoirs (30).

Base Block

Figure 1A:
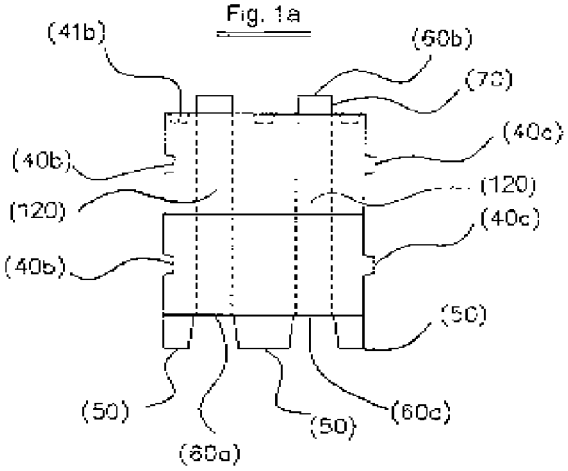
FIG. 1 illustrates a base block of a hydrophilic revetment block having seawater flow ports in accordance with the first embodiment of the present invention.
Figure 1D:
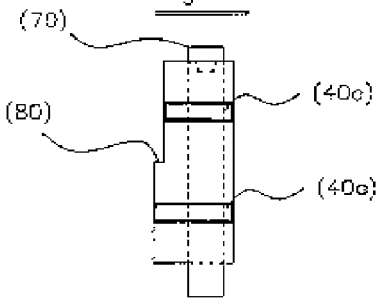
Figure 1B:
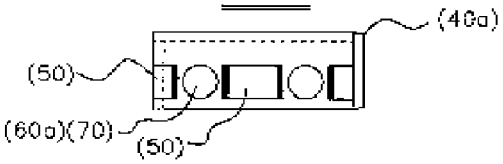
Figure 1C:
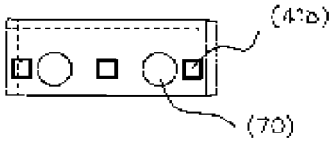
Figure 1E:
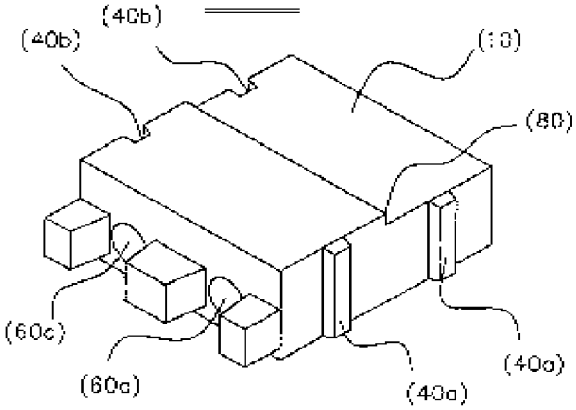

FIG. 1 illustrates a base block (10) of a hydrophilic revetment block having seawater flow ports (120) in accordance with the present invention.

At the top of the base block (10), a step for preventing slip (80) is formed to prevent the block from being slipped along the inclination by base pressure. When constructing the block, the inclination of stairs can be changed by adjusting the spacing of the step (80).

At the font of the block, projections (50) are formed to break waves and provide stairs for people depending on the change of seawater level.

And, one or more seawater flow ports (120) with circular or polygonal cross-section formed from the front through the rear of the base block (two seawater flow ports having circular cross-section are shown in FIG. 1) are provided for smooth flow of seawater. Seawater flow pipes (70) are inserted in the seawater flow ports (120). The pipes (70) can be longer than the base block (10) for more convenient construction.

At one side of the block, at least one engagement projections (40*a*) are formed to enhance engagement with other blocks. At the opposite side, at least one engagement indentations (40*b*) are formed and at the rear of the base block (10), at least one engagement indentations (41*b*) are formed to enhance engagement against differential settlement or wave pressure.

FIG. 5 illustrates a base block which further comprises gates (90) at the inflow port (60*a*) or the outflow port (60*b*) of the base block (10) for control of seawater volume. The gates (90) may be opened and closed manually or automatically.

Intermediate Connection Block

Figure 2A:
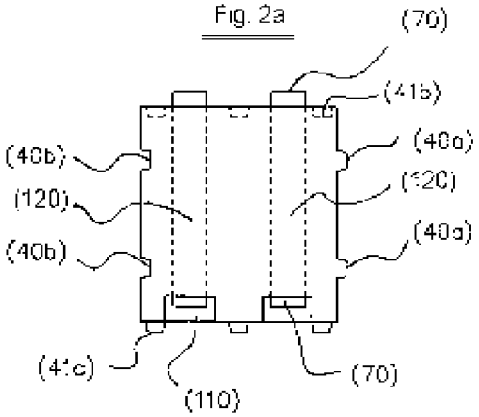
FIG. 2 illustrates an intermediate connection block of a hydrophilic revetment block having seawater flow ports in accordance with the present invention.
Figure 2D:
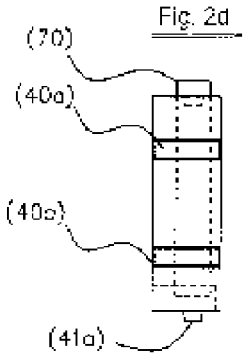
Figure 2B:
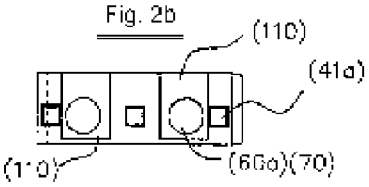
Figure 2C:
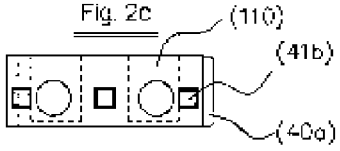
Figure 2E:
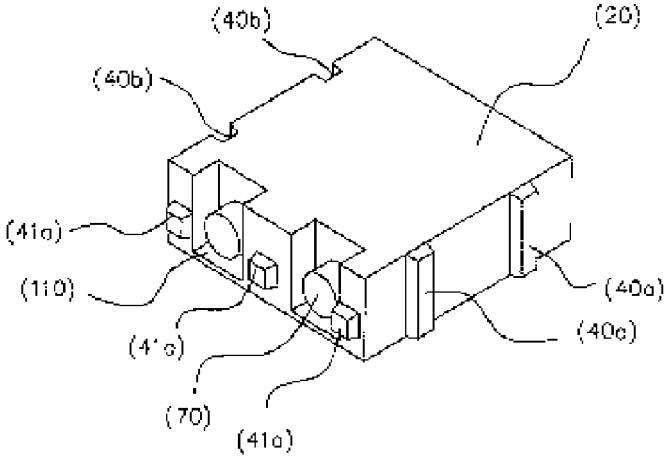

FIG. 2 illustrates an intermediate connection block (20) of a hydrophilic revetment block having seawater flow ports in accordance with the present invention, in which at least one seawater flow pipes (70) having circular or polygonal cross-section are inserted at regular intervals inside the block and one or more (two in FIG. 2) space for connecting seawater flow pipes (110) are formed at one or both sides for enhancing engagement of the seawater flow pipes (70). Outside the block, a plurality of engagement projections (40*a*, 41*a*) and a plurality of engagement indentations (40*b*, 41*b*) are formed to enhance engagement with other blocks. The seawater flow pipes (70) are longer than the block for more convenient construction. After assembly, the remaining space of the space for connecting seawater flow pipes (110) is preferably filled with mortar or rubble, as illustrated in FIG. 4.

Intermediate Connection Block Having Reservoirs

FIG. 3 illustrates an intermediate connection block (30) having reservoirs (30*a*) for controlling seawater flow. The intermediate connection block having reservoirs (30) is mostly the same as the intermediate connection block (20), except for the reservoirs (30*a*). The reservoirs (30*a*) may be formed as indentation formed at the top or bottom of the block or as path penetrating the block from up to down. Preferably, position, number and shape of the reservoirs (30*a*) are selected depending on the situation of the construction site.

Specific Construction Examples

Hereinafter, construction examples using the base block (10), the intermediate connection block (20) and the intermediate connection block (30) having reservoirs (30*a*) are described referring to the attached drawings.

FIG. 4 illustrates connection of the seawater flow pipes (70) of the base block (10) and the intermediate connection block (20).

FIG. 5 illustrates a base block (10) which further comprises gates (90) at the inflow port (60*a*) or outflow port (60*b*) of the base block for control of inflow or outflow seawater. FIG. 5(*a*)

is a front view and FIG. 5(*b*) is a perspective view. The gates (90) may be operated manually or mechanically.

FIG. 6 is a cross-sectional view illustrating the construction that allows horizontal flow of seawater from the open sea to the inland sea and vice versa by aligning the base blocks (10) and the intermediate connection blocks (20).

FIG. 7 illustrates a construction example for preventing counterflow of seawater from the inland sea to the open sea by providing level difference of the inflow port (60*a*) and the outflow port (60*b*). That is, because the inflow port (60*a*) is formed above the outflow port (60*b*), seawater flows in constantly and counterflow can be prevented, without regard to the change in seawater level.

FIG. 8 is a perspective view illustrating a construction example in accordance with the present invention. The example shown in FIG. 8 can be modified depending on the situation of the construction site.

FIG. 9 illustrates a construction example in accordance with the present invention.

FIG. 10 illustrates the conventional construction example. Levels of the inflow port (60*a*) and the outflow port (60*b*) are fixed and a foundation mound (100) and protection rubble (140) are used in this example.

INDUSTRIAL APPLICABILITY

While the present invention has been described in detail with reference to the preferred embodiments, those skilled in the art will appreciate that various modifications and substitutions can be made thereto without departing from the spirit and scope of the present invention as set forth in the appended claims.

The invention claimed is:

1. A hydrophilic revetment block comprising one or more base blocks and one or more intermediate connection blocks, said base block comprising:

a step for preventing slip formed on the upper part of the base block;

a plurality of projections formed at the front of the base block;

one or more water flow passages having the shape of circular, polygonal, or a combination thereof cross-section formed from the front through the rear of the base block;

and at least one engagement projection formed at one side of the base block, at least one engagement indentation formed at the opposing side of the base block and at least one engagement indentations formed at the rear of the base block for enhancing engagement with other blocks, wherein water flow pipes are formed in the water flow passage, said water flow pipes being longer than the base block for easy connection with other pipes, and said intermediate connection block installed at the rear of the base block or another intermediate connection block comprising:

at least one water flow passage having the shape of circular, polygonal or a combination thereof cross-section formed from the front through the rear of the intermediate connection block;

at least one space for connection of water flow pipes formed at one or both ends of the intermediate connection block to enhance engagement to water flow pipes;

optionally at least one reservoir formed as a path penetrating the block from up to down or as an indentation at the top or bottom of the block; and at least one engagement projection formed at one side of the intermediate connection block, at least one engagement indentation formed at the opposing side of the intermediate connection block, at least one engagement projection formed at the front of the intermediate connection block and at least one engagement indentation formed at the rear of the intermediate connection block for enhancing engagement with other blocks, wherein additional water flow pipes are optionally formed in the water flow passages, said additional water flow pipes being longer than the intermediate connection block for easy connection with other pipes;

wherein at least one of the intermediate blocks comprises at least one reservoir;

wherein the hydrophilic revetment block separates two bodies of water;

and wherein the base blocks and intermediate blocks are connected and form at least one conduit extending from one side of the hydrophilic revetment block adjacent to the first body of water to the other side of the hydrophilic revetment block adjacent to the second body of water and there is a change in level in the conduit.

2. The hydrophilic revetment block as set forth in claim 1, wherein gates capable of being opened and closed manually or automatically are provided at one or more water flow passages of at least one base block for control of water circulation.

3. The hydrophilic revetment block as set forth in claim 1, wherein the change in level in the conduit is a step change.

4. A construction method using the hydrophilic revetment block of claim 1 that prevents counterflow of water from a first body of water to a second body of water at a predetermined depth, which comprises the steps of:

setting up a foundation mound using rubble;

aligning a base block, an intermediate connection block and an intermediate connection block having reservoirs horizontally on the foundation mound so that each water flow passage of the base block, the intermediate connection block and the intermediate connection block having reservoirs is connected in such a manner that the intermediate connection block having reservoirs which is the third block from the second body of water is positioned so that its reservoirs face the opposite direction of the foundation mound and base blocks are positioned at both ends of the construction site;

repeating the above step of aligning the base block, the intermediate connection block and the intermediate connection block having reservoirs horizontally to form stairs in such a manner that the intermediate connection block having reservoirs which is the second block from the second body of water is positioned so that its reservoirs are communicated with the reservoirs of the intermediate connection block below to form level difference between the water flow passage on the second body of water side and the water flow passage on first body of water side, so that control of horizontal flow of water is possible;

filling the remaining space of the space for connection of water flow pipes with mortar or rubble; and applying concrete on the blocks positioned at the top of the stairs to form a concrete roof structure;

wherein the step of forming stairs is performed by stacking the base blocks so that the step of the lower base block engages with the upper base block.

5. The construction method as set forth in claim 4, wherein the spacing of the step for preventing slip is adjusted to form stairs with various inclinations.

* * * * *